US007717616B2

(12) United States Patent
Bron

(10) Patent No.: US 7,717,616 B2
(45) Date of Patent: May 18, 2010

(54) TIMEPIECE WITH AN HOUR HAND ABLE TO BE MOVED FORWARD OR BACKWARD BY ONE HOUR STEP

(75) Inventor: Alphonse Bron, Bassecourt (CH)

(73) Assignee: Omega SA, Bienne (CH)

( * ) Notice: Subject to any disclaimer, the term of this patent is extended or adjusted under 35 U.S.C. 154(b) by 149 days.

(21) Appl. No.: 11/011,620

(22) Filed: Dec. 15, 2004

(65) Prior Publication Data

US 2005/0128875 A1 Jun. 16, 2005

(30) Foreign Application Priority Data

Dec. 16, 2003 (EP) ..... 03028875

(51) Int. Cl.
*G04B 27/04* (2006.01)
*G04B 19/20* (2006.01)

(52) U.S. Cl. ..... 368/192; 368/38

(58) Field of Classification Search ..... 368/21–22, 368/191–192, 38
See application file for complete search history.

(56) References Cited

U.S. PATENT DOCUMENTS

| | | | | |
|---|---|---|---|---|
| 3,710,567 | A * | 1/1973 | Cleusix | 368/35 |
| 3,765,162 | A | 10/1973 | Ushiyama et al. | |
| 3,844,107 | A * | 10/1974 | Guyot | 368/22 |
| 3,871,169 | A * | 3/1975 | Schwaar et al. | 368/27 |
| 3,882,669 | A * | 5/1975 | Jakob | 368/38 |
| 5,383,165 | A | 1/1995 | Vaucher | |
| 6,597,635 | B2 * | 7/2003 | Dalloz | 368/21 |
| 2003/0112706 | A1 | 6/2003 | Dalloz | |
| 2003/0151983 | A1 * | 8/2003 | Speichinger et al. | 368/190 |

FOREIGN PATENT DOCUMENTS

| | | | |
|---|---|---|---|
| CH | 388 855 | | 11/1964 |
| CH | 655 221 G | A3 | 4/1986 |
| CH | 685 965G | A3 | 11/1995 |
| EP | 0 579 093 | A1 | 1/1994 |
| EP | 1 178 373 | A1 | 2/2002 |
| FR | 2 124 469 | | 9/1972 |
| FR | 2 207 302 | | 6/1974 |

OTHER PUBLICATIONS

European Search Report, completed Sep. 9, 2004.

* cited by examiner

*Primary Examiner*—Vit W Miska
*Assistant Examiner*—Sean Kayes
(74) *Attorney, Agent, or Firm*—Griffin & Szipl, P.C.

(57) ABSTRACT

Time zone timepiece including an hour hand (6) capable of being moved forward or backward in one hour steps by means of a manually actuated time setting stem (28) without affecting the minute display, said hand (6) being fitted onto an hour pipe (4) about which an hour hand (2) is adjusted to pivot freely, driven by a motion work (10), an additional wheel (12) secured to the pipe (4) driving an additional device, the hour wheel (2) being coupled to the additional wheel (12) by a limited torque mechanism (16), the timepiece being characterised in that, outside the periods in which the time zone time is being corrected, the hour wheel (2) and the additional wheel (12) are further rigidly coupled by a second coupling mechanism.

21 Claims, 6 Drawing Sheets

TIMEPIECE WITH AN HOUR HAND ABLE TO BE MOVED FORWARD OR BACKWARD BY ONE HOUR STEP

This application claims priority from European Patent Application No. 03028875.7 filed Dec. 16, 2003, the entire disclosure of which is incorporated herein by reference.

The present invention concerns a time zone timepiece whose hour hand can be moved forward or backward in one hour steps by means of a manually actuated time setting stem, without, however, affecting the minute display.

A timepiece of the aforecited type can be useful for a traveller when he passes from one time zone to another and he has to adjust his watch to the new time. Since the time difference of this new time relative to the old time, is a whole hour in one direction or another, it is useful for the person wearing the watch to have means available for instantaneously moving the position of the hour hand forward or backward by a whole hour without affecting the minute display.

To solve the problem raised hereinbefore, CH Patent No. 388 855 in the name of Ruch and CH Patent No. 685 965 in the name of Ulysse Nardin are already known.

The Ruch Patent concerns a timepiece including a local time indicating member, a time zone time indicating disc rotating about a pipe of the hour wheel, and a jumper and star-wheel device connecting said disc to the hour wheel.

The Ulysse Nardin Patent concerns a timepiece including an hour hand capable of being moved forward in one hour steps by means of two manually actuated push-buttons, the hand being fitted onto a pipe, first and second levers controlled by the two push-buttons acting on the teeth of a correction star-wheel fixed onto the pipe, an hour wheel fitted to pivot freely about said pipe being coupled to the correction star-wheel by a jumper mechanism, whereas an additional wheel secured to the correction star-wheel, drives a date disc. The Ulysse Nardin Patent also concerns a timepiece providing an indication of a time zone time. It does not mention the driving of an additional device such as a date mechanism.

The Ulysse Nardin Patent concerns a timepiece providing an indication of a time of a zone time. This patent differs however from the Ruch Patent in that the time zone indication is provided not by a disc, but by the hour hand which can be moved forward or backward in one hour steps without affecting the minute display. Moreover, the Ulysse Nardin Patent proposes driving a date mechanism. It is, however, a so-called dragging date mechanism, i.e. a mechanism which takes around two hours to pass from one indication to another. The use of a dragging date mechanism instead of an instantaneous date mechanism, i.e. a mechanism having a device allowing the date to pass instantaneously at midnight, is explained by the fact that the torque opposed by an instantaneous date mechanism when the time of the watch is set in the anticlockwise direction, is greater than the click torque between the hour wheel and the correction star-wheel, which leads to a shift of the hour hand when the calendar is driven, or even in extreme cases, to the driving of the calendar being stopped, while the hour hand moves forward less than half a step then falls back into its original position. To the Applicant's knowledge, this problem has, to date, never been solved, which is why a time zone watch of the type described hereinbefore including an instantaneous date mechanism, has never been put on the market.

It is an object of the present invention to overcome the aforementioned problem in addition to others by providing a time zone timepiece including an additional device opposing a resistant torque, which can be greater than the coupling torque between the hour wheel and the additional wheel.

The present invention therefore concerns a time zone timepiece including an hour hand capable of being moved forward or backward by one hour by means of a manually actuated time setting stem without affecting the minute display, characterised in that it further includes an instantaneous date mechanism.

Owing to these features, one has the possibility of quickly moving the hour hand in one hour steps without going through a usual time setting operation, which enables the minute and second display to be preserved since the watch is not stopped during correction of the time of the zone time. Moreover, the timepiece according to the invention includes an instantaneous date mechanism, which gives it a resolutely innovative appearance and gives the user increased confidence in the quality of the mechanism.

According to another aspect of the invention, the present invention concerns a time zone timepiece including an hour hand capable of being forward or backward in one hour steps by means of a manually actuated time setting stem without affecting the minute display, this hand being fitted onto a pipe about which an hour hand, driven by a motion work, is fitted to pivot freely, an additional wheel secured to the pipe driving an additional device, the hour hand being coupled to the additional wheel by a limited torque mechanism, the timepiece being characterised in that, outside periods in which the time of the time zone is being corrected, the hour hand and the additional wheel are also rigidly coupled by a second coupling mechanism.

According to a feature of the invention, the second coupling mechanism includes a pinion, which meshes simultaneously with the hour wheel and the additional wheel.

Usually, the only function of the torque given by the mechanism used for coupling the hour wheel and the additional wheel is to move the hour hand forward or backward by one hour steps to correct the time of the zone time or take account of the change from summer time to winter time or vice versa. The role of this torque becomes, however, a leading one when an additional device is driven by the additional wheel. Indeed, in order to assure a proper operation of the watch, this torque has to be greater than the resistant torque opposed by the additional device. In the case of watches that are currently available on the market, this condition is always fulfilled, insofar as the additional device is typically a dragging, or at best a semi-instantaneous, date mechanism. This is not the case when the additional device opposes a resistant torque greater than the torque given by the mechanism used to couple the hour wheel and the additional wheel. In this latter case, one can go as far as to observe this additional device and the hour hand stopping. This is why, in accordance with the invention, it is proposed, outside periods when the time zone is being corrected, to rigidly couple the hour wheel and the additional wheel by means of a coupling pinion. Thus, the limited torque mechanism used to couple the hour wheel and the additional wheel no longer has the function only of positioning the hour hand when the time zone is changed, which only requires a very low torque and, consequently, one that is easy to make in a small volume. In all other cases, the coupling of the hour wheel and the additional wheel is accomplished by a pinion. This arrangement proves particularly advantageous when the additional device takes the form of an instantaneous date mechanism. Indeed, such a mechanism opposes a resistant torque more than four times greater than the torque of the mechanism, which usually connects the hour wheel to the additional wheel when the time is being set in the anti-clockwise direction.

Other features and advantages of the present invention will appear more clearly from the following detailed description of an example embodiment of a timepiece according to the invention, this example being given purely by way of non-limiting illustration, in conjunction with the annexed drawing, in which.

The present invention proceeds from the general inventive idea, which consists, during all of the operating phases of a time zone timepiece except those that consist in adjusting the time of the zone time, in rigidly coupling the hour wheel and the additional wheel by means of a coupling pinion. Consequently, transmission of the torque from the motion work to the additional device during the operating and time setting phases passes through the hour wheel, the coupling pinion and the additional wheel. The transmission of force between the hour wheel and the additional wheel is thus deviated via the coupling pinion, the limited torque mechanism which enables the hour wheel and the additional wheel to be coupled no longer being operated except when the time of the zone time is being set, the coupling pinion being, in this latter case, disengaged.

The present invention will be described in conjunction with an additional device of the instantaneous date mechanism type. It goes without saying that this example is given purely by way of illustration and that the additional device can take any other form provided that it is driven by the additional wheel.

It will also be understood that "setting the time of the watch" means the conventional time setting thereof, i.e. the operation that consists in moving the hour hand and the minute hand forward or backward in a concomitant manner, while "setting the time of the zone time" means the operation that consists in moving the hour hand alone forward or backward in one hour steps, the minute hand remaining still.

Figure 1:
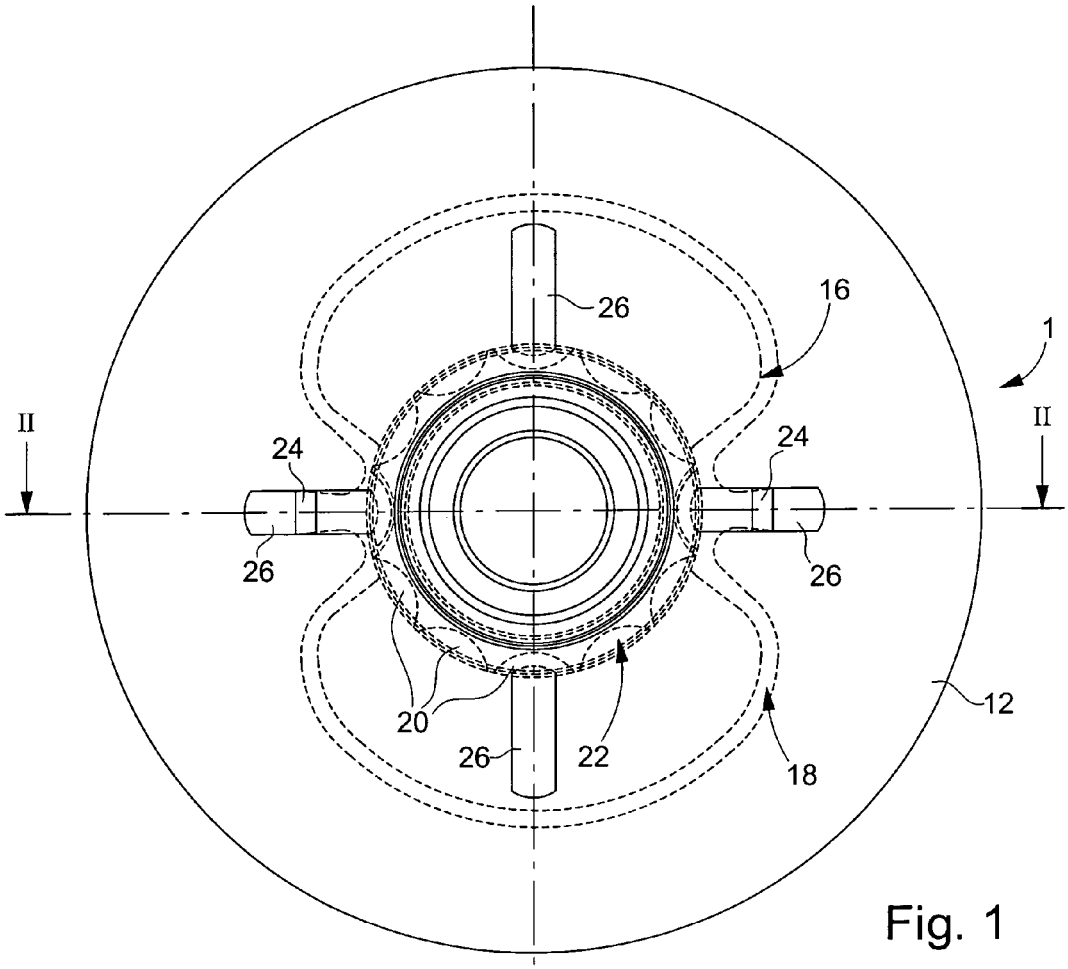
FIG. 1 is a top view of a time zone mechanism.
Figure 2:
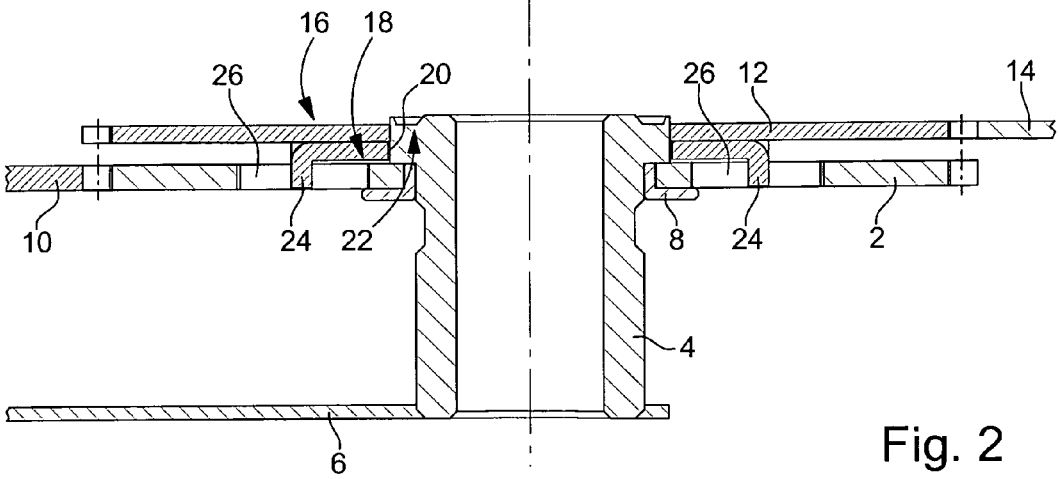
FIG. 2 is a cross-sectional view along the line II-II of the time zone mechanism shown in FIG. 1.

FIGS. 1 and 2 are, respectively, top and cross-sectional views of the time zone mechanism according to the invention. Designated as a whole by the general reference numeral 1, this mechanism includes an hour wheel 2 adjusted so as to pivot freely about an hour wheel pipe 4 onto which is fitted an hour hand 6. Hour wheel 2, mounted on pipe 4 via a washer 8, is driven by a motion work 10. An additional wheel 12, secured to hour pipe 4, drives an additional device. In the present case, this additional device includes an instantaneous jump date mechanism designated as a whole by the general reference numeral 14. It goes without saying that this example is given solely by way of non-limiting illustration, and that any other type of watch mechanism can form the additional device, provided that it is driven by additional wheel 12. The choice of an instantaneous date mechanism simply allows the advantages provided by the present invention to be demonstrated, as will be described in detail hereinafter.

Hour wheel 2 is coupled to additional wheel 12 by a limited torque mechanism 16 which includes a spring 18 acting on teeth 20 of a correction star-wheel 22. The correction star-wheel 22 can be integral with hour pipe 4 as shown in FIG. 2. According to an alternative embodiment, correction star-wheel 22 can also be formed by a separate part secured to said pipe 4.

The general operating principle of time zone mechanism 1 illustrated in FIGS. 1 and 2 is as follows. In a normal operating period of the watch, motion work 10 drives hour wheel 2 which itself drives additional wheel 12 via spring 18 and correction star-wheel 22.

Indeed, the spring has two substantially vertical returning portions, which dip into two diametrically opposite corresponding elongated holes 26, arranged in hour wheel 2, said spring 18 being secured in rotation by said returning portions to said hour wheel 2. Thus, when hour wheel 2 rotates, it drives spring 18, which in turn drives correction star-wheel 22. Since the latter is secured to hour wheel 4, hour hand 6 moves forward and additional wheel 12 rotates, driving date mechanism 14. Conversely, when one wishes to change time zone, one rotates a time setting stem 28 (see FIG. 3 and following) which drives the additional wheel via a correction gear train 30. During the time that it takes to change the time zone, hour wheel 2 can be considered as being practically immobile. Consequently, additional wheel 10, and thus hour pipe 4 and correction star-wheel 22 rotate, whereas spring 18, immobilised in rotation by hour wheel 2, is compressed and jumps from a space between two teeth 20 of correction star-wheel 22 to the space immediately after. The work of spring 18 in compression and then let down is made possible by the fact that its returning portions 24 are free to move radially in elongated holes 26 of additional wheel 12 in which they are received. Thus, hour hand 6 can move forward or backward in one hour steps without the minute display being altered, although the watch continues to work. It will be noted that for the coupling of the two wheels to be possible, hour wheel 2 and additional wheel 12 must also have the same number of teeth and the same module. Furthermore, the teeth of the two wheels 2 and 12 have to be superposed when they are assembled and the number thereof must be a multiple of twelve.

As already explained hereinbefore, the main interest of the invention lies in the fact that it provides a timepiece including a mechanism for changing the time of a time zone to which an additional device can be added, such as an instantaneous date mechanism, which opposes a resistant torque that can be up to four times higher than the torque produced by the mechanism used to couple the hour wheel to the additional wheel. Such a timepiece will be described with reference to FIG. 3 and following, annexed to the present patent application.

Figure 3:
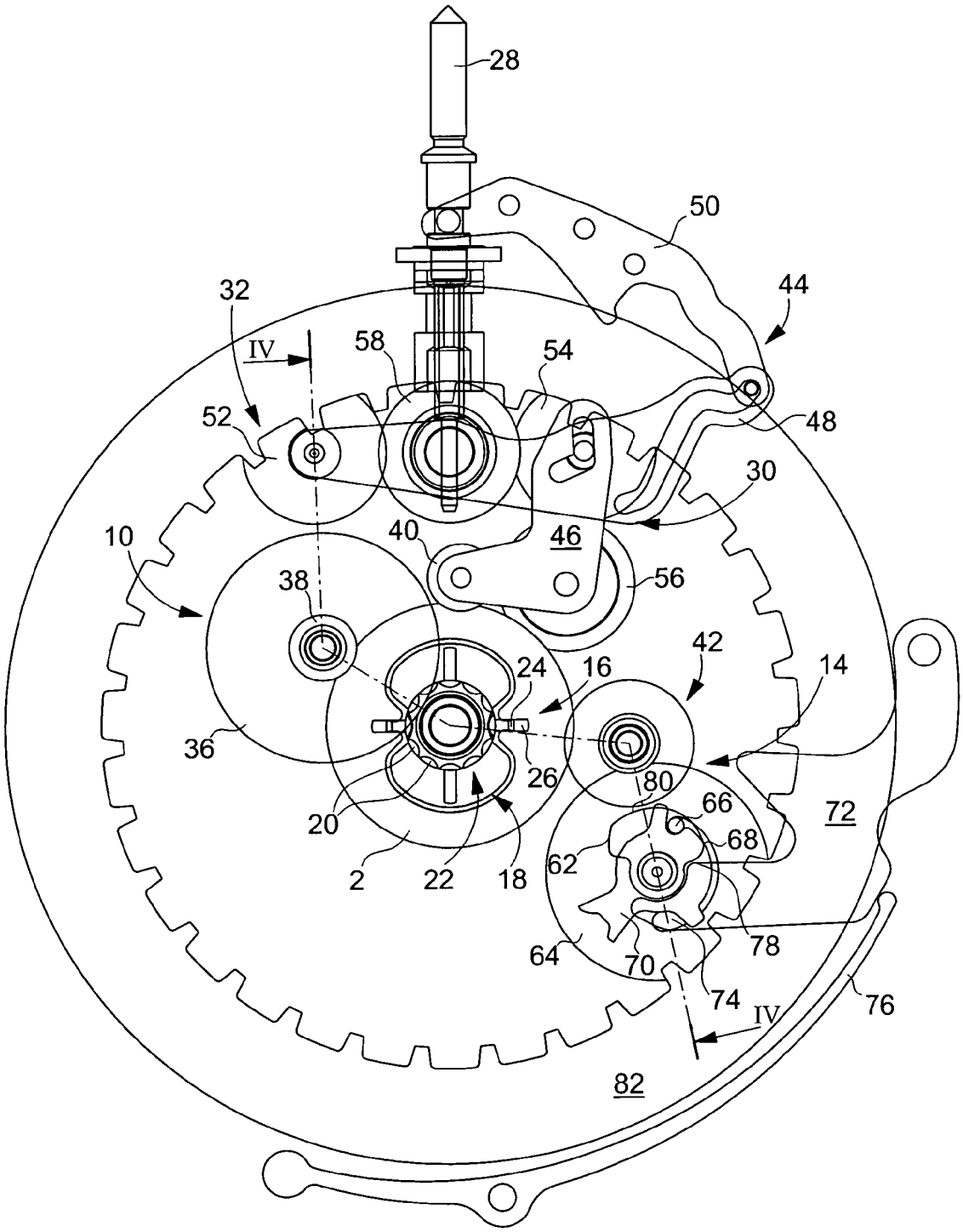
FIG. 3 is a top view of the time setting gear train and of the date mechanism when the time setting stem is in its rest position corresponding to normal operation and, as appropriate, to the winding position of the timepiece.
Figure 4:
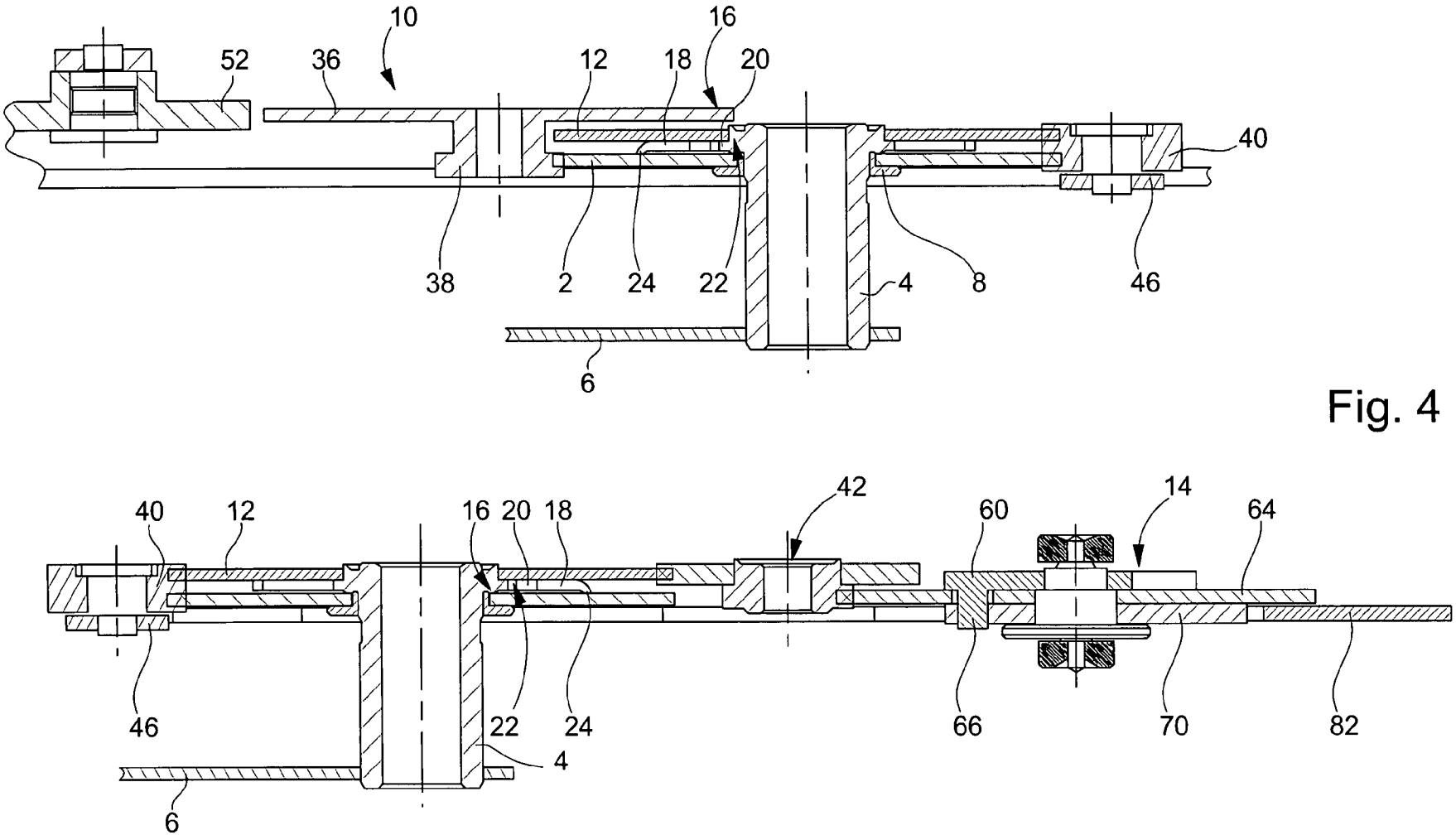
FIG. 4 is a cross-sectional view along the line IV-IV of the time setting gear train and of the date mechanism shown in FIG. 3.

FIGS. 3 and 4 are views, respectively top and cross-sectional views, of the time setting gear train 32 and of the date mechanism 14 when the time setting stem 28 is in its rest position corresponding to normal working, and, where appropriate, to the winding position of the timepiece when the latter is driven by a barrel spring (not shown). In this position of time setting stem 28, motion work 10 is driven by the cannon-pinion (not shown). Motion work 10 includes a motion work wheel 36 and a motion work pinion 38, which only drives hour wheel 2. In turn, hour wheel 2 drives additional wheel 12, without, however, coupling mechanism 16, which includes correction star-wheel 22 and spring 18, being solicited. In fact, hour wheel 2 and additional wheel 12 are rigidly coupled by a coupling pinion 40, which transmits the movement of said hour wheel 2 to said additional wheel 12. Finally, the additional wheel meshes with an intermediate wheel set 42, which itself drives date mechanism 14.

As can be seen upon examining FIGS. 3 and 4, coupling pinion 40 is carried by a rod assembly 44. More specifically, this rod assembly 44 includes a coupling lever 46 which carries coupling pinion 40 and whose position is controlled by a control lever 48, which is itself controlled by a pull-out piece 50 connected to time setting stem 28. It can also be seen that control lever 48 carries two sliding pinions, namely a time setting sliding pinion 52 and an additional sliding pinion 54. Depending upon the position occupied by control lever 48, time setting sliding pinion 52 and additional sliding pinion 54 mesh respectively with motion work wheel 36 or with an additional intermediate wheel 56 which itself drives additional wheel 12. Finally, the rotational movements imparted by the user of the watch to time setting stem 28 are communicated to sliding pinions 52 and 54 via a corrector intermediate wheel 58 with which said two sliding pinions mesh. Coupling lever 46 is pivoted on the arbour of additional intermediate wheel 56, whereas control lever 48 is pivoted on the arbour of corrector intermediate wheel 58.

Figure 5:
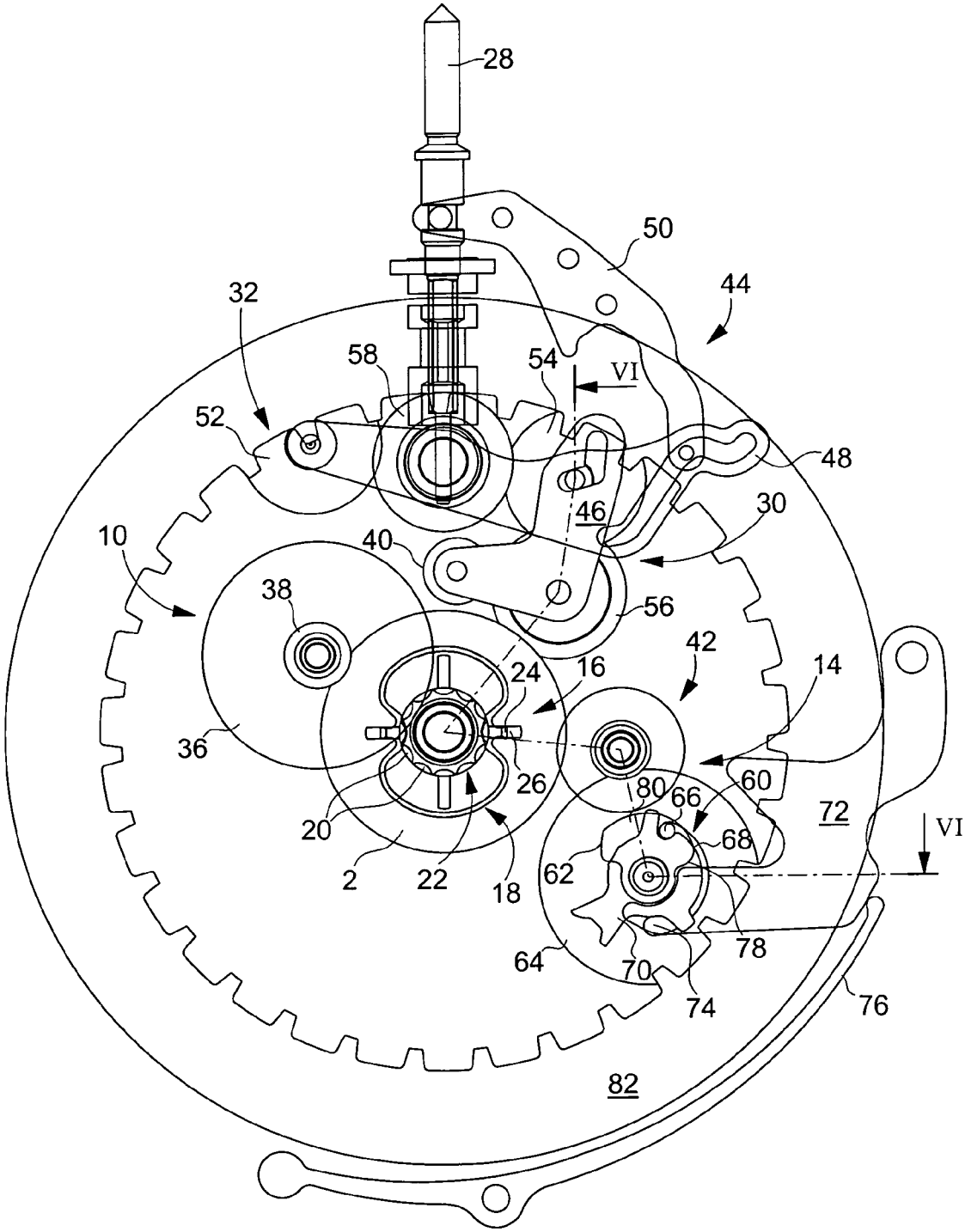
FIG. 5 is a top view of the time setting gear train and of the date mechanism when the time setting stem is in a first pulled-out position for correcting the time zone.
Figure 6:
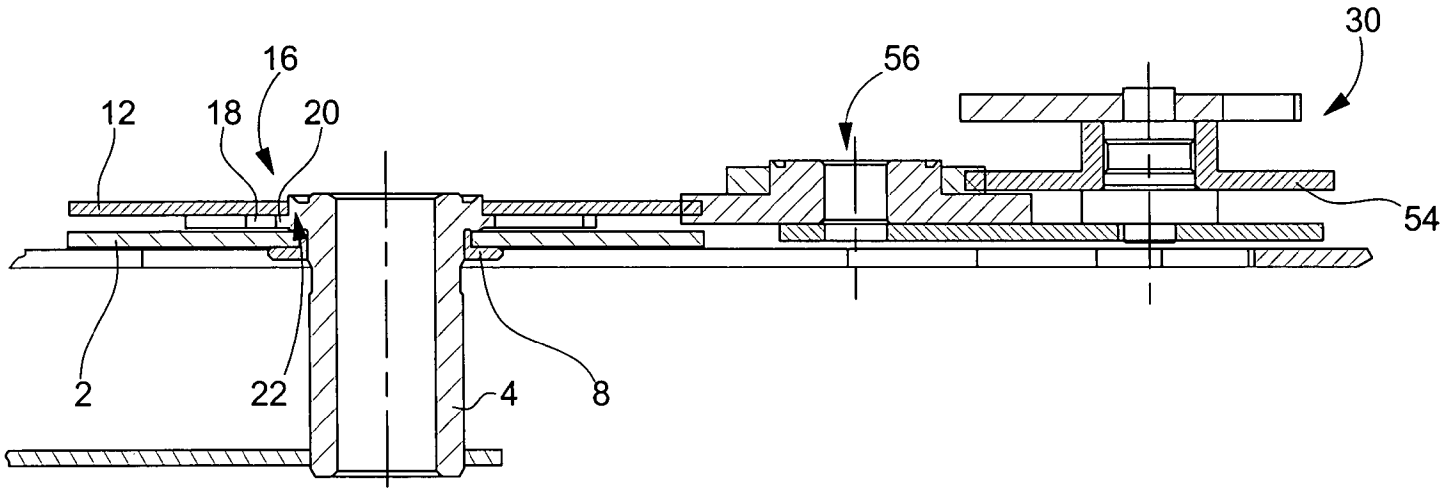
FIG. 6 is a cross-sectional view along the line VI-VI of the time setting gear train and of the date mechanism shown in FIG. 5.
Figure 6:
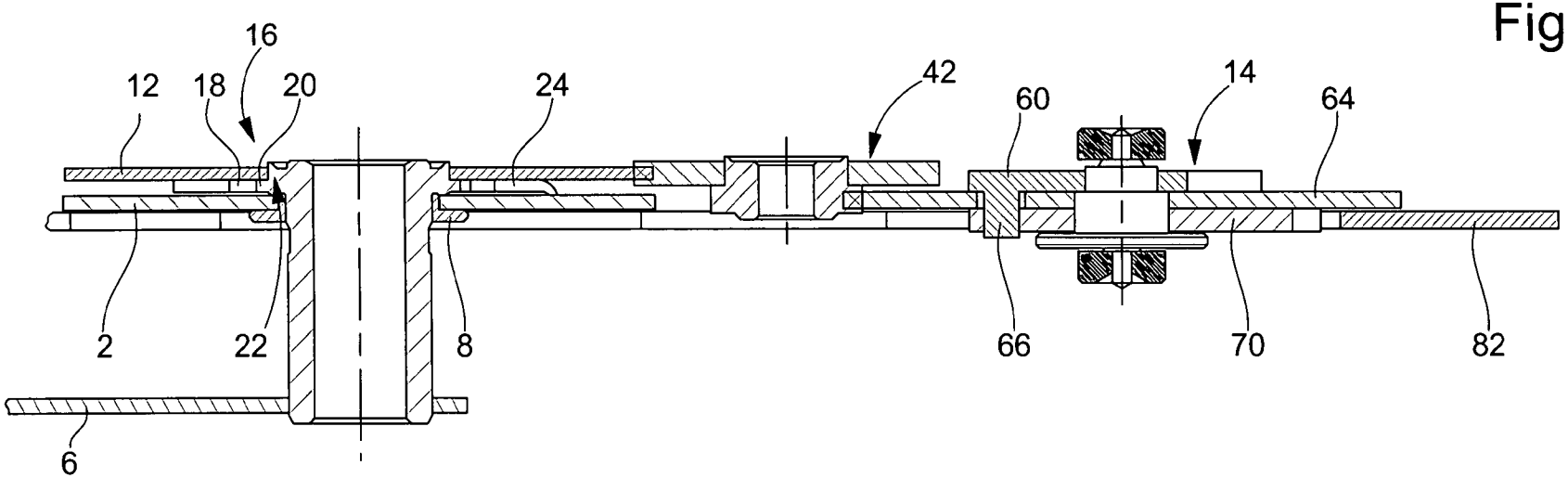

FIGS. 5 and 6 are respectively top and cross-sectional views of time setting gear train 32 and date mechanism 14 when time setting stem 28 is in a first pulled out position for correcting the time zone time. In this first pulled out position of time setting stem 28, pull out piece 50 pivots and in turn causes control lever 48 and coupling lever 46 to pivot so as to move coupling pinion 40 away so that it is no longer meshed with hour wheel 2 and additional wheel 12. At the same time, additional sliding pinion 54 meshes with additional intermediate wheel 56, which is itself meshed with additional wheel 12. In this position of time setting stem 28, time zone mechanism 1 plays its conventional part. In fact, when the user rotates said time setting stem 28, this causes the simultaneous rotation of corrector intermediate wheel 58, of additional sliding pinion 54, additional intermediate wheel 56 and finally, additional wheel 12. While rotating, additional wheel 12 drives correction star-wheel 22. During the time that it takes to change the time zone, hour wheel 2 can be considered as being practically immobile. Consequently, spring 18 is immobilised in rotation by said hour wheel 2, and will be compressed and jump from a space between two teeth 20 of correction star-wheel 22 to the space immediately after. Thus, hour hand 6 can move forward or backward in one hour steps without the minute display being altered, although the watch continues to work.

Figure 7:
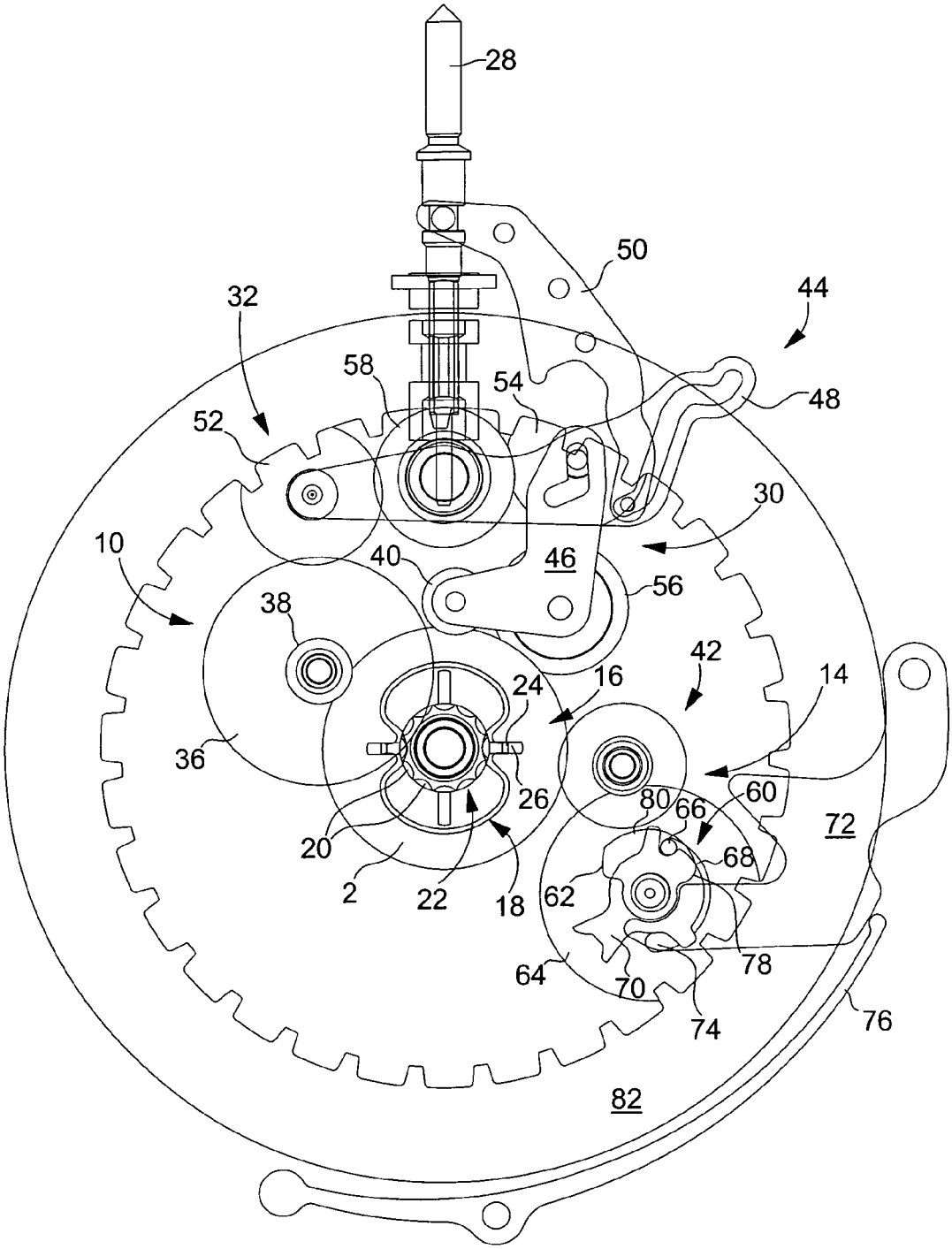
FIG. 7 is a top view of the time setting gear train and of the date mechanism when the time setting stem is in a second pulled-out position for setting the time of the timepiece.

FIG. 7 is a top view of time setting gear train 32 and of date mechanism 14 when time setting stem 28 is in a second pulled out position for setting the time of the watch, a position in which time setting sliding pinion 52 meshes with motion work 10, which itself drives hour wheel 2 coupled to additional wheel 12 by coupling pinion 40.

When the time of the watch is being adjusted in the clockwise direction, it does not raise any particular problems. The user rotates time setting stem 28 whose rotational movement is transmitted to time setting sliding pinion 52 via corrector intermediate wheel 58. Time setting sliding pinion 52 then meshes with motion work 10 whose pinion 38 drives hour wheel 2. In turn, hour wheel 2 drives additional wheel 12 via coupling pinion 40 via which these two wheels 2 and 12 are rigidly coupled. Finally, additional wheel 12 meshes with intermediate wheel set 42, which itself drives date mechanism 14. As can be observed, when the time of the watch is adjusted in the clockwise direction, the situation is identical to the normal operation mode of the watch.

The difficulties arise when the time of the watch is adjusted in the anti-clockwise direction. In fact, in this case, the date mechanism can oppose a resistant torque which can be up to four times higher than the torque of mechanism 16 to spring 18, via which hour wheel 2 and additional wheel 12 are coupled. In such case, coupling pinion 40 via which said hour wheel 2 and additional wheel 12 are rigidly coupled, plays its part fully. In fact, in the absence of this coupling pinion 40, it would be quite impossible to set the time of the watch anti-clockwise. This is due to the fact that date mechanism 14 is an instantaneous jump mechanism, including, in particular, a cam 60 whose profile has a steep slope 62 at one location on its length. More specifically, instantaneous jump date mechanism 14 includes a date wheel 64 driven by intermediate wheel set 42 and which in turn drives cam 60 via a pin 66. Pin 66 is housed in a slot 68 arranged in date wheel 64 inside which said pin 66 is capable of moving. Date mechanism 14 also includes a mobile finger 70 that is free to rotate with respect to date wheel 64 but is connected in rotation to cam 60 via pin 66. Finally date mechanism 14 includes a trigger lever 72 whose beak 74 is kept applied against the profile of cam 60 by a spring 76.

An instantaneous date mechanism is, let us recall, a mechanism allowing the date to change instantaneously at midnight. The time for winding the elements of the mechanism is several hours, typically of the order of eighteen hours, the energy being abruptly returned at midnight. In the present case, energy is provided by trigger lever 72, which, following the profile of cam 60, moves away from its rest position and enables spring 76 to store energy. During the date mechanism winding phase, beak 74 of trigger lever 72 first of all encounters a gentle slope 78, then a contour 80, before abruptly falling at steep slope 62. When lever 72 falls, it causes finger 70 and cam 60 to pivot, finger 70 driving a date ring 82 through one step. At the same time, pin 66 moves into slot 68 and the system remains in that state until date wheel 64 has caught up with said pin 66.

Thus, it is clear that if the time of the watch is set in the anti-clockwise direction, it can happen that beak 74 of trigger lever 72 is forced to climb up steep slope 62 of cam 60. The date mechanism then opposes such a high resistant torque that, in the absence of coupling pinion 40, time zone mechanism 1 could not operate and would stop the calendar being driven, while the hour hand would move forward less than one step and fall back into its initial position. The presence of coupling pinion 40, which temporarily couples hour wheel 2 and additional wheel 12 rigidly, enables this problem to be solved by providing a higher coupling torque than the resistant torque opposed by the date mechanism.

It goes without saying that the present invention is not limited to the embodiment that has just been described and that those skilled in the art can envisage various simple alterations and variants without departing from the scope of the present invention.

What is claimed is:

1. A time zone timepiece including:

(a) an hour hand capable of moving forward or backward in one hour steps by means of a manually actuated time setting stem without affecting a minute display, wherein the minute display includes a minute hand and said hour hand is fitted onto an hour pipe about which an hour wheel is adjusted to pivot freely, driven by a motion work; and (b) an additional wheel secured to the hour pipe driving an additional device, wherein the hour wheel is coupled to the additional wheel by a first coupling mechanism comprising a limited torque mechanism; and (c) a second coupling mechanism moveable between a first position and a second position, wherein when the second coupling mechanism is in the first position the second coupling mechanism rigidly couples the hour wheel and the additional wheel, and when the second coupling mechanism is in the second position the second coupling mechanism is disengaged from the hour wheel and the additional wheel, and wherein the additional device displays a time-related information but not the current time displayed by the hour hand and the minute hand.

2. The timepiece according to claim 1, wherein the hour wheel is coupled to the additional wheel via a spring that acts on teeth of a correction star-wheel integral with the hour pipe or fixed thereto.

3. The timepiece according to claim 2, wherein the spring has two vertical returning portions that penetrate two diametrically opposite corresponding elongated holes arranged in the hour wheel.

4. The timepiece according to claim 1, wherein the hour wheel is mounted so as to pivot freely about the hour pipe via a washer.

5. The timepiece according to claim 1, wherein a coupling pinion is kinematically connected to the time setting stem by a rod assembly.

6. The timepiece according to claim 5, wherein the rod assembly includes a coupling lever that carries the coupling pinion and that is articulated so as to pivot on a control lever, wherein the control lever is articulated so as to pivot on a pull out piece connected to the time setting stem.

7. The timepiece according to claim 6, wherein the control lever carries a time setting sliding pinion and an additional sliding pinion.

8. The timepiece according to claim 7, wherein the time setting stem can occupy three distinct positions, namely, (i) a rest position for normal working and, where appropriate, for winding the timepiece, (ii) a first pulled out position for correcting time zone, and (iii) a second pulled out position for setting time of the timepiece.

9. The timepiece according to claim 8, wherein, in the rest position of the time setting stem, a first wheel set connected to the motion work meshes solely with the hour wheel that is coupled to the additional wheel by the coupling pinion, the additional wheel meshing with an intermediate wheel set that drives the additional device, whereas, in the first pulled out position of the time setting stem, the coupling pinion is disengaged and the additional sliding pinion meshes with an additional intermediate wheel that drives the additional wheel, wherein rotational movement of the time setting stem is communicated to the additional sliding pinion via an intermediate correction wheel, and wherein, in the second pulled out position of the time setting stem, the time setting sliding pinion meshes with the first wheel set connected to the motion work that drives the hour wheel coupled to the additional wheel by the coupling pinion, wherein rotational movement of the time setting stem is communicated to the time setting sliding pinion by the intermediate correction wheel.

10. The timepiece according to claim 1, wherein the hour wheel and the additional wheel have the same module and the same number of teeth, this number of teeth is a multiple of twelve, and wherein the teeth of both wheels are superposed during assembly.

11. The timepiece according to claim 1, wherein the time-related information refers to time in hours and minutes.

12. A time zone timepiece including:

(a) an hour hand capable of moving forward or backward in one hour steps by means of a manually actuated time setting stem without affecting a minute display, wherein the minute display includes a minute hand and said hour hand is fitted onto an hour pipe about which an hour wheel is adjusted to pivot freely, driven by a motion work;

(b) an additional wheel secured to the hour pipe driving an additional device, wherein the hour wheel is coupled to the additional wheel by a first coupling mechanism comprising a limited torque mechanism; and (c) a second coupling mechanism moveable between a first position and a second position, wherein when the second coupling mechanism is in the first position the second coupling mechanism rigidly couples the hour wheel and the additional wheel, and when the second coupling mechanism is in the second position the second coupling mechanism is disengaged from the hour wheel and the additional wheel, and wherein the additional device displays a time-related information but not the current time displayed by the hour hand and the minute hand, and wherein the second coupling mechanism includes a pinion that simultaneously meshes both the hour wheel and the additional wheel when in the first position.

13. The timepiece according to claim 12, wherein the additional device is an instantaneous jump date mechanism that opposes a resistant torque higher than a limited torque of the limited torque mechanism via which the hour wheel is coupled to the additional wheel.

14. The timepiece according to claim 13, wherein the additional wheel drives the instantaneous jump date mechanism via an intermediate wheel set.

15. The timepiece according to claim 13, wherein the instantaneous jump date mechanism includes a trigger lever held against a cam by a spring, and the cam is connected by a pin to a mobile finger that drives a date ring.

16. The timepiece according to claim 14, wherein the instantaneous jump date mechanism includes a trigger lever held against a cam by a spring, and the cam is connected by a pin to a mobile finger that drives a date ring.

17. The timepiece according to claim 12, wherein the time-related information refers to time in hours and minutes.

18. A time zone timepiece including:

(a) an hour hand capable of moving forward or backward in one hour steps by means of a manually actuated time setting stem without affecting a minute display, wherein said hand is fitted onto an hour pipe about which an hour wheel is adjusted to pivot freely, driven by a motion work;

(b) an additional wheel secured to the hour pipe driving an additional device, wherein the hour wheel is coupled to the additional wheel by a first coupling mechanism comprising a limited torque mechanism; and (c) a second coupling mechanism moveable between a first position and a second position, wherein when the second coupling mechanism is in the first position the second coupling mechanism rigidly couples the hour wheel and the additional wheel, and when the second coupling mechanism is in the second position the second coupling mechanism is disengaged from the hour wheel and the additional wheel, and wherein the additional device is an instantaneous jump date mechanism that opposes a resistant torque higher than a limited torque of the limited torque mechanism via which the hour wheel is coupled to the additional wheel, and the second coupling mechanism is in the second position when time zone time of the time zone timepiece is corrected.

19. The timepiece according to claim 18, wherein the additional wheel drives the instantaneous jump date mechanism via an intermediate wheel set.

20. The timepiece according to claim 19, wherein the instantaneous jump date mechanism includes a trigger lever held against a cam by a spring, and the cam is connected by a pin to a mobile finger that drives a date ring.

21. The timepiece according to claim 18, wherein the instantaneous jump date mechanism includes a trigger lever held against a cam by a spring, and the cam is connected by a pin to a mobile finger that drives a date ring.

* * * * *